US011125221B2

(12) United States Patent
Wang

(10) Patent No.: US 11,125,221 B2
(45) **Date of Patent: *Sep. 21, 2021**

(54) INFLATOR

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/809,878

(22) Filed: Mar. 5, 2020

(65) Prior Publication Data

US 2020/0300232 A1 Sep. 24, 2020

(30) Foreign Application Priority Data

Mar. 20, 2019 (TW) ..... 108109622

(51) Int. Cl.
*F04B 33/00* (2006.01)
*F04B 53/10* (2006.01)
*F04B 39/00* (2006.01)

(52) U.S. Cl.
CPC ..... *F04B 33/00* (2013.01); *F04B 39/0005* (2013.01); *F04B 53/10* (2013.01)

(58) Field of Classification Search
CPC ..... F04B 33/00; F04B 53/10; F04B 39/0005; F04B 39/12; F04B 39/0016; F04B 25/005; F04B 29/00; F04B 39/123
See application file for complete search history.

(56) References Cited

U.S. PATENT DOCUMENTS

| | | | | |
|---|---|---|---|---|
| 5,676,529 | A * | 10/1997 | Hermansen | F04B 33/005 417/259 |
| 7,353,746 | B2 * | 4/2008 | Kutella | F04B 49/18 92/61 |
| 10,598,165 | B2 * | 3/2020 | Wang | F04B 17/03 |
| 2009/0104059 | A1 * | 4/2009 | Wang | F04B 19/022 417/468 |
| 2017/0167477 | A1 * | 6/2017 | Hermansen | F04B 33/005 |
| 2020/0300233 | A1 * | 9/2020 | Wang | F04B 25/02 |

* cited by examiner

*Primary Examiner* — Essama Omgba
*Assistant Examiner* — Dnyanesh G Kasture

(57) ABSTRACT

An inflator includes a mouthpiece, an adjustment mechanism, and an air cylinder mechanism that includes a large-diameter cylinder permitted to move relative to the mouthpiece. When the large-diameter cylinder is moved away from the mouthpiece, air from external environment is sucked into a first space of the air cylinder mechanism. The adjustment mechanism is operable to switch between a pressure relief state, where air in the first space is released to the external environment when the large-diameter cylinder is moved toward the mouthpiece, and a sealed state, where the air in the first space is injected into the mouthpiece when the large-diameter cylinder is moved toward the mouthpiece.

8 Claims, 8 Drawing Sheets

INFLATOR

CROSS-REFERENCE TO RELATED APPLICATION

This application claims priority of Taiwanese Patent Application No. 108109622, filed on Mar. 20, 2019.

FIELD

The disclosure relates to an inflator, and more particularly to a manual inflator.

BACKGROUND

A manual miniature inflator, which is commonly used for inflating vehicle tires, can be easily carried outdoor without requiring too much additional resources. A conventional inflator disclosed in Taiwanese Utility Model Patent Publication No. 263020 is designed as a dual-action inflator, which is able to push air into an inflatable object when the inflator is being pushed in one direction and when the inflator is being pulled in the opposite direction, expediting air pumping process. However, the dual-action inflator is complicated in design and requires delicate components that can easily increase manufacturing and repair costs.

SUMMARY

Therefore, an object of the disclosure is to provide an inflator that can alleviate the drawback of the prior art.

According to the disclosure, the inflator includes a mouthpiece, an air cylinder mechanism, and an adjustment mechanism.

The air cylinder mechanism includes a connecting tube, a small-diameter cylinder, a large-diameter cylinder, a unidirectional intake plug, a piston, a unidirectional communication plug, a first check valve set and a second check valve set.

The connecting tube extends axially in a front-rear direction. The small-diameter cylinder extends axially, sleeves around the connecting tube, and has a front end fixedly connected to the adjustment mechanism. The large-diameter cylinder extends axially and sleeves around the small-diameter cylinder. The intake plug is fixedly mounted to a front end of the large-diameter cylinder and sleevedly abuts against an outer surrounding surface of the small-diameter cylinder. The piston is fixedly mounted to a rear end of the small-diameter cylinder and airtightly abuts against an inner surrounding surface of the large-diameter cylinder and an outer surrounding surface of the connecting tube. The communication plug is fixedly mounted to a front end of the connecting tube, is fluidly communicated to the connecting tube and the small-diameter cylinder, and abuts against an inner surrounding surface of the small-diameter cylinder. The first check valve set is mounted between the connecting tube and the communication plug. The second check valve set removably seals the front end of the small-diameter cylinder.

The adjustment mechanism is fixedly mounted to a rear end of the large-diameter cylinder and a rear end of the connecting tube, and cooperates with the piston to define a first space therebetween. The adjustment mechanism includes an adjustment seat that is fixedly mounted between the rear ends of the large-diameter cylinder and the connecting tube, and that has an intake hole and an exhaust hole both of which fluidly communicates the first space to external environment, a unidirectional valve that is mounted to the adjustment seat, and that openably seals the intake hole, and an exhaust valve set that is mounted to the adjustment seat, and that is operable to openably seal the exhaust hole.

The piston and the intake plug cooperatively define a second space therebetween, the communication plug and the piston cooperatively define a third space therebetween that is in fluid communication with the second space, and the communication plug and the second check valve set cooperatively define a fourth space therebetween.

While the adjustment mechanism is in a pressure relief state, the exhaust valve set does not seal the exhaust hole, so that the exhaust hole may release air from the first space to the external environment. While the adjustment mechanism is in a sealed state, the exhaust valve set seals the exhaust hole.

When the large-diameter cylinder is moved away from the mouthpiece, air from external environment is sucked into the first space via the unidirectional valve of the adjustment mechanism, and air in the second space and the third space is pushed to flow into the fourth space via the communication plug, and the second check valve set is capable of being driven by air pressure of the fourth space to open. When the large-diameter cylinder is moved toward the mouthpiece, the air from the external environment is sucked into the second space via the intake plug and flows into the third space, air in the first space is pushed to flow into the connecting tube and air in the connecting tube is pushed to open the first check valve set while the adjustment mechanism is in the sealed state, and the air in the first space is released via the exhaust hole of the adjustment seat while the adjustment mechanism is in the pressure relief state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
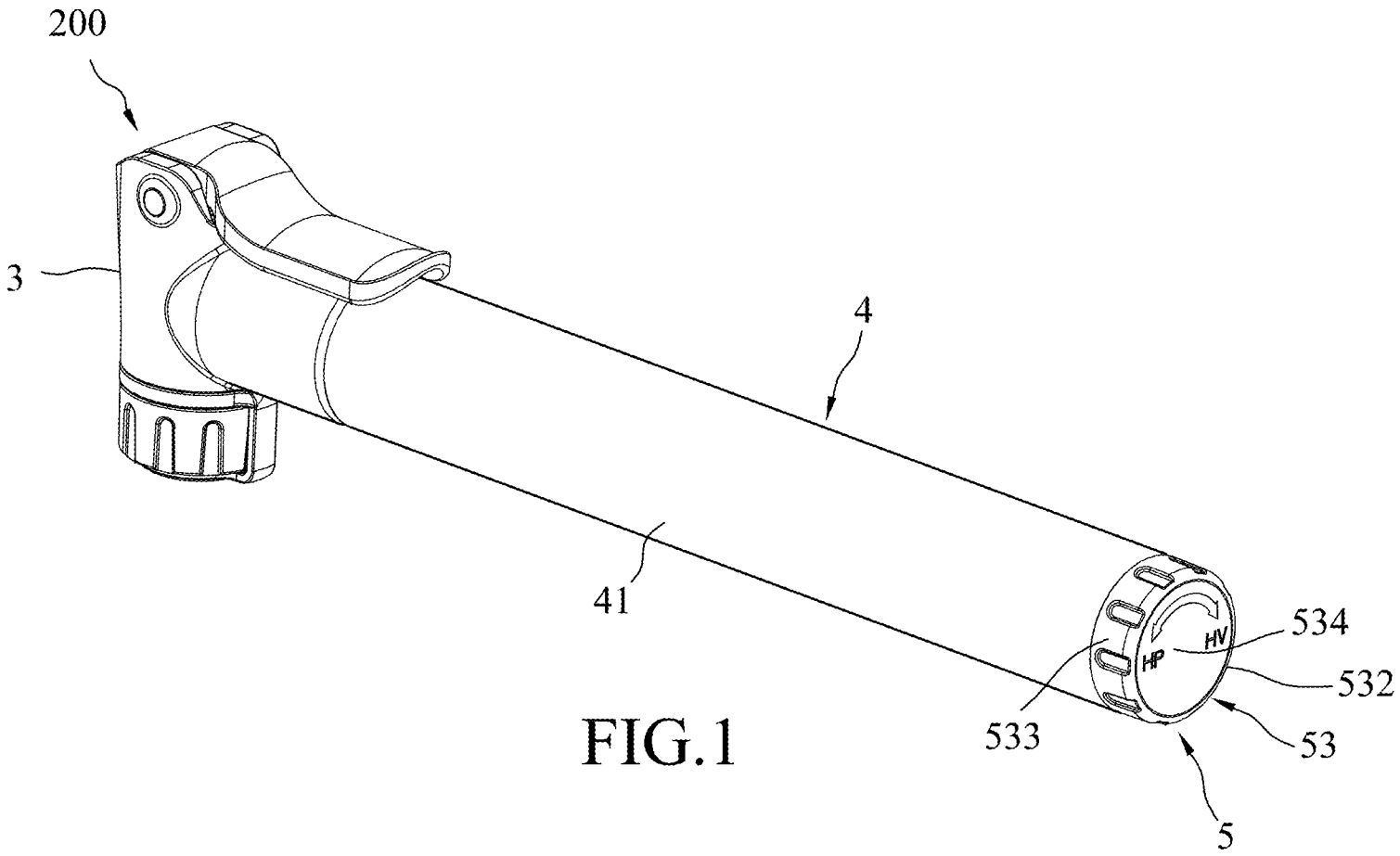
FIG. 1 is a perspective view of an embodiment of an inflator according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
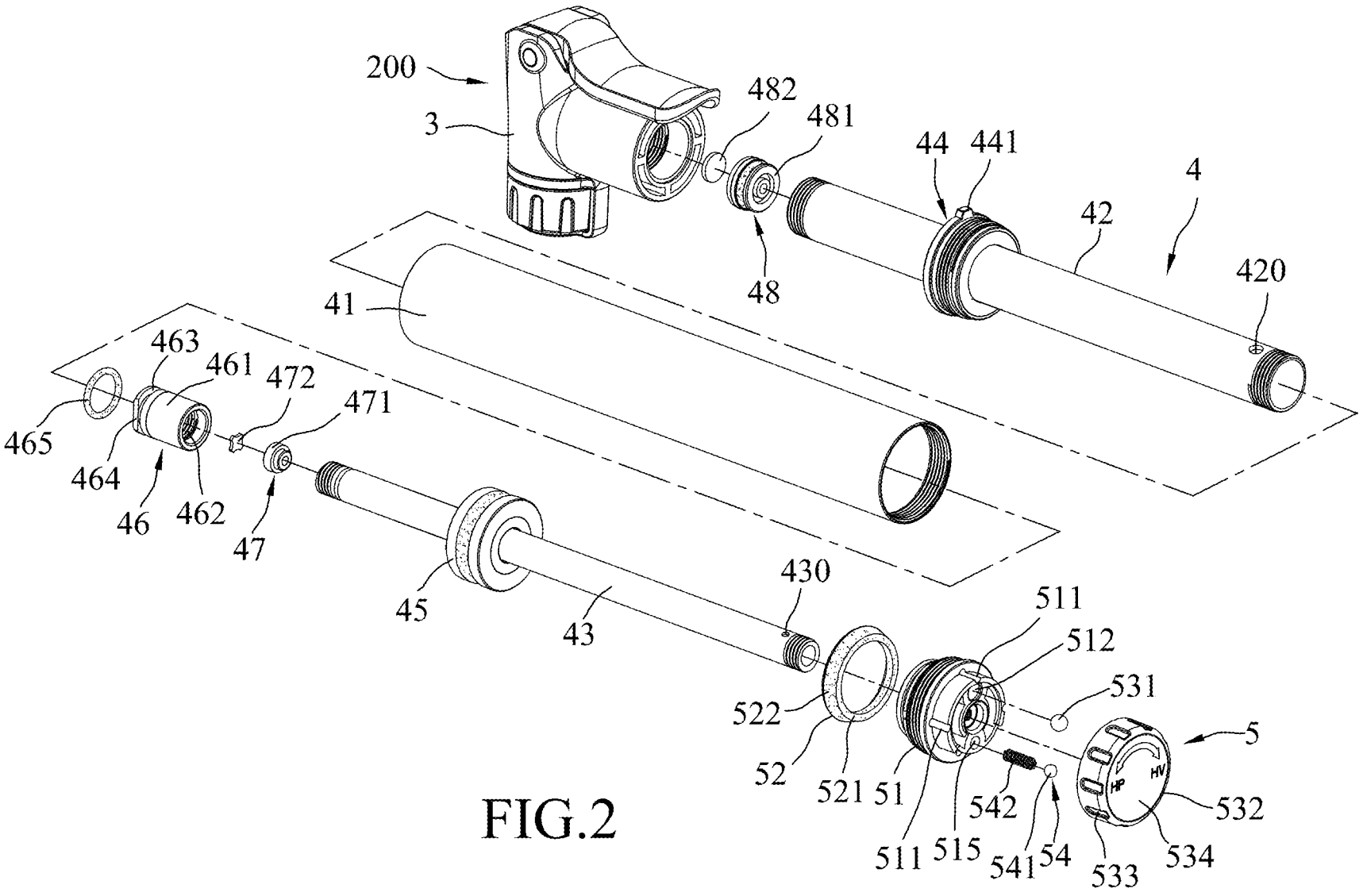
FIG. 2 is an exploded perspective view of the embodiment.
Figure 3:
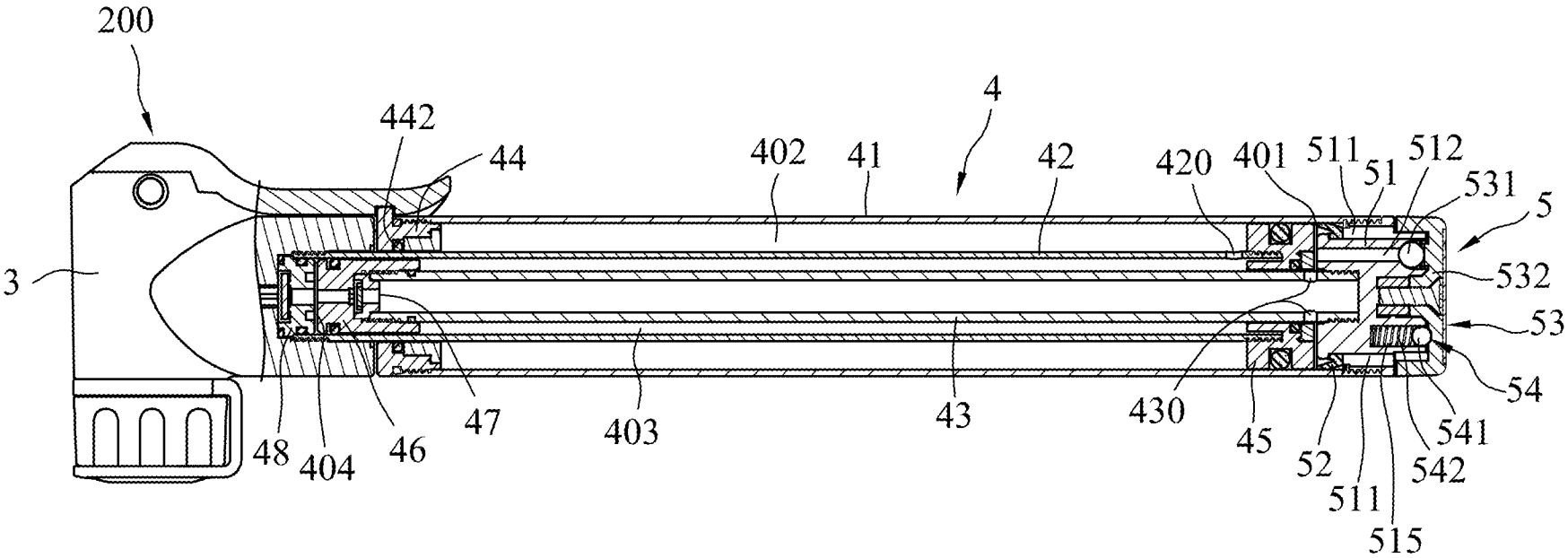
FIG. 3 is a side sectional view of the embodiment.

Referring to FIGS. 1 to 3, an embodiment of an inflator 200 according to the disclosure is adapted for inflating an inflatable object (not shown), such as tires or balls. The inflator 200 includes a mouthpiece 3, an air cylinder mechanism 4 that extends axially in a front-rear direction and that has a front end fixedly connected to the mouthpiece 3, and an adjustment mechanism 5 fixedly mounted to a rear end of the air cylinder mechanism 4. The mouthpiece 3 is adapted to be installed onto the inflatable object for transporting air thereinto. In addition, the mouthpiece 3 may come in different forms or shapes, and is not restricted to the one shown in the embodiment.

The air cylinder mechanism 4 includes a large-diameter cylinder 41, a small-diameter cylinder 42, a connecting tube 43, a unidirectional intake plug 44, a piston 45, a unidirectional communication plug 46, a first check valve set 47, and a second check valve set 48. The connecting tube 43 extends axially and has a rear end fixedly mounted to the adjustment mechanism 5. The small-diameter cylinder 42 extends axially, sleeves around the connecting tube 43, and has a front end fixedly connected to the mouthpiece 3. The large-diameter cylinder 41 extends axially, sleeves around the small-diameter cylinder 42, and has a rear end fixedly mounted to the adjustment mechanism 5. The intake plug 44 is fixedly mounted to a front end of the large-diameter cylinder 41 and sleevedly abuts against an outer surrounding surface of the small-diameter cylinder 42. The piston 45 is fixedly mounted to a rear end of the small-diameter cylinder 42 and airtightly abuts against an inner surrounding surface of the large-diameter cylinder 41 and an outer surrounding surface of the connecting tube 43. The communication plug 46 fluidly communicates the connecting tube 43 and the small-diameter cylinder 42, is fixedly mounted to a front end of the connecting tube 43, and abuts against an inner surrounding surface of the small-diameter cylinder 42. The first check valve set 47 is mounted between the connecting tube 43 and the communication plug 46. The second check valve set 48 removably seals the front end of the small-diameter cylinder 42.

The piston 45 and the adjustment mechanism 5 cooperatively define a first space 401 therebetween, and the piston 45 and the intake plug 44 cooperatively define a second space 402 therebetween. The connecting tube 43 is formed with a through hole 430 the extends radially through the rear end thereof and that fluidly communicates the first space 401 to the connecting tube 43.

The intake plug 44 is permitted to unidirectionally and fluidly communicate the second space 402 to external environment, and includes an end block 441 that is fixedly mounted to the front end of the large-diameter cylinder 41 and that sleeves around the small-diameter cylinder 42, and a plug gasket 442 that is movably mounted to an inner surface of the end block 441 and that airtightly abuts against the small-diameter cylinder 42. When the intake plug 44 moves rearwardly relative to the small-diameter cylinder 42, the intake plug 44 airtightly seals the second space 402 from the external environment. On the other hand, when the intake plug 44 moves forwardly relative to the small-diameter cylinder 42, the intake plug 44 is unsealed so that the second space 402 is fluidly communicated to the external environment. As there are other designs of the intake plug 44 that also permits unidirectional air flow from the external environment to the second space 402, the intake plug 44 implemented in other embodiments may vary, and is not restricted to the design disclosed herein.

Figure 4:
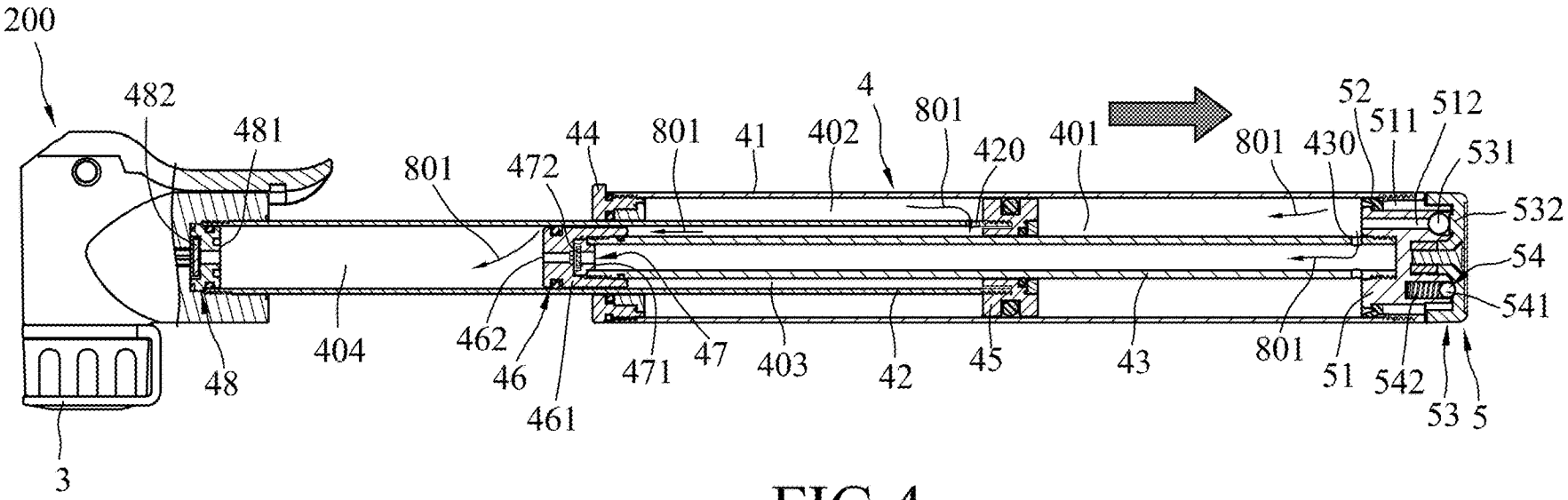
FIG. 4 is a view similar to FIG. 3, illustrating a large-diameter cylinder of the air cylinder mechanism of the embodiment being moved rearwardly relative to a mouthpiece of the embodiment.
Figure 5:
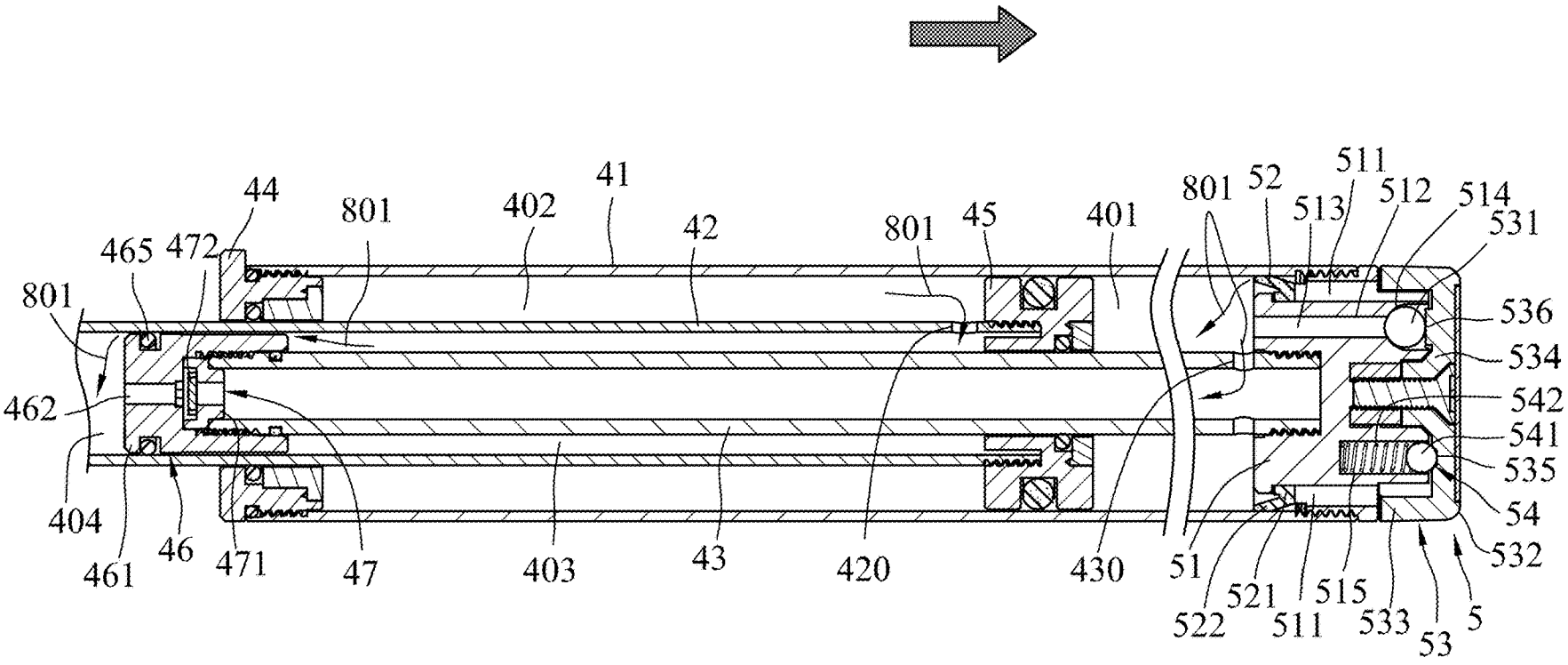
FIG. 5 is an enlarged fragmentary view of FIG. 4.

Referring to FIGS. 2, 4 and 5, the communication plug 46 and the piston 45 cooperatively define a third space 403 therebetween, and the communication plug 46 and the second check valve set 48 cooperatively define a fourth space 404 therebetween. The small-diameter cylinder 42 is formed with a through hole 420 that extends radially therethrough and that fluidly communicates the second space 402 to the third space 403. The communication plug 46 includes a plug body 461 that is fixedly mounted to the front end of the connecting tube 43 and that has an axial hole 462 axially and fluidly communicating the connecting tube 43 and the fourth space 404 of the air cylinder mechanism 4, and a piston gasket 465 that is axially movable, that sleeves around the plug body 461 and that airtightly abuts against the inner surrounding surface of the small-diameter cylinder 42. the plug body 461 has an outer annular groove 463 that indents from an outer surface of the plug body 461 and that is for the piston gasket 465 to movably sleeve thereto, and two cutoff openings 464 (only one is visible in FIG. 2) that axially and fluidly communicate the outer annular groove 463 and the fourth space 404. When the plug body 461 of the communication plug 46 moves rearwardly relative to the small-diameter cylinder 42, the piston gasket 465 unseals the cutoff openings 464 so that the third space 403 is fluidly communicated to the fourth space 404. On the other hand, when the plug body 461 of the communication plug 46 moves forwardly relative to the small-diameter cylinder 42, the piston gasket 465 seals a gap between the plug body 461 and the small-diameter cylinder 42, essentially sealing communication between the third space 403 and the fourth space 404 via the cutoff openings 464. As there are other designs of the communication plug 46 that also permits unidirectional air flow from the third space 403 to the fourth space 404, the communication plug 46 implemented in other embodiments may vary, and is not restricted to the design disclosed herein.

The first check valve set 47 has an annular valve seat 471 that is disposed between the front end of the connecting tube 43 and the plug body 461 and that fluidly communicates the connecting tube 43 to the axial hole 462, and a check valve member 472 that is mounted to the valve seat 471 and that is permitted to be driven by air pressure difference between the connecting tube 43 and the fourth space 404 to openably seal free flow therebetween via the axial hole 462. When the air pressure in the fourth space 404 is higher than that of the connecting tube 43, the first check valve set 47 is driven by the air pressure in the fourth space 404 to seal, thereby cutting off free flow between the fourth space 404 and the connecting tube 43. However, when the air pressure in the fourth space 404 is lower than that of the connecting tube 43, the first check valve set 47 is driven by the air pressure in the connecting tube 43 to open, such that the communication plug 46 fluidly communicates the connecting tube 43 and the fourth space 404.

The second check valve set 48 includes an annular valve block 481 that is fixedly mounted in the front end of the small-diameter cylinder 42 and that fluidly communicates the mouthpiece 3 to the fourth space 404, and a check valve member 482 that is mounted to the valve block 481 and that is permitted to be driven by air pressure of the forth space 404 to openably seal the valve block 481. When the air pressure in the mouthpiece 3 is higher than that of the fourth space 404, the second check valve set 48 is driven by the air pressure in the mouthpiece 3 to seal, thereby cutting off free flow between mouthpiece 3 and the fourth space 404.

However, when the air pressure in mouthpiece 3 is lower than that of the fourth space 404, the second check valve set 48 is driven by the air pressure in the fourth space 404 to open to fluidly communicate the fourth space 404 and mouthpiece 3.

The first and second check valve sets 47, 48 implemented in other embodiments may vary in design, and is not restricted to the design disclosed herein.

Figure 7:
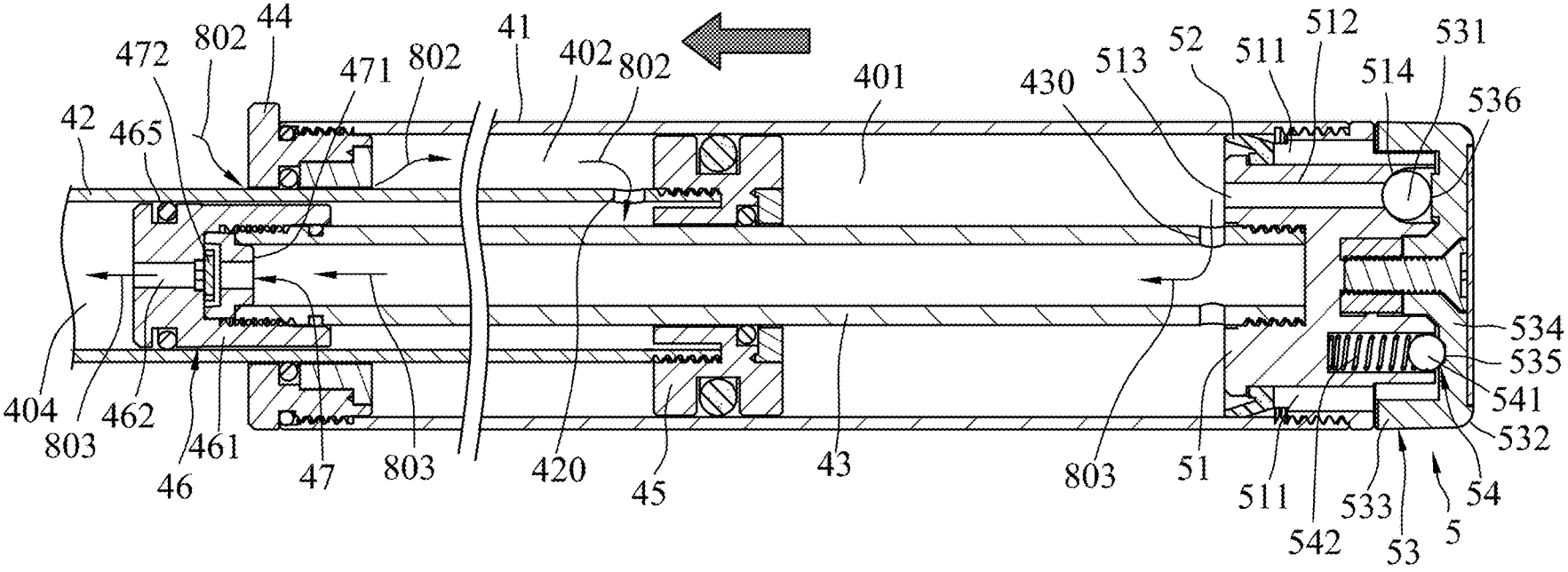
FIG. 7 is an enlarged fragmentary view of FIG. 6.
Figure 8:
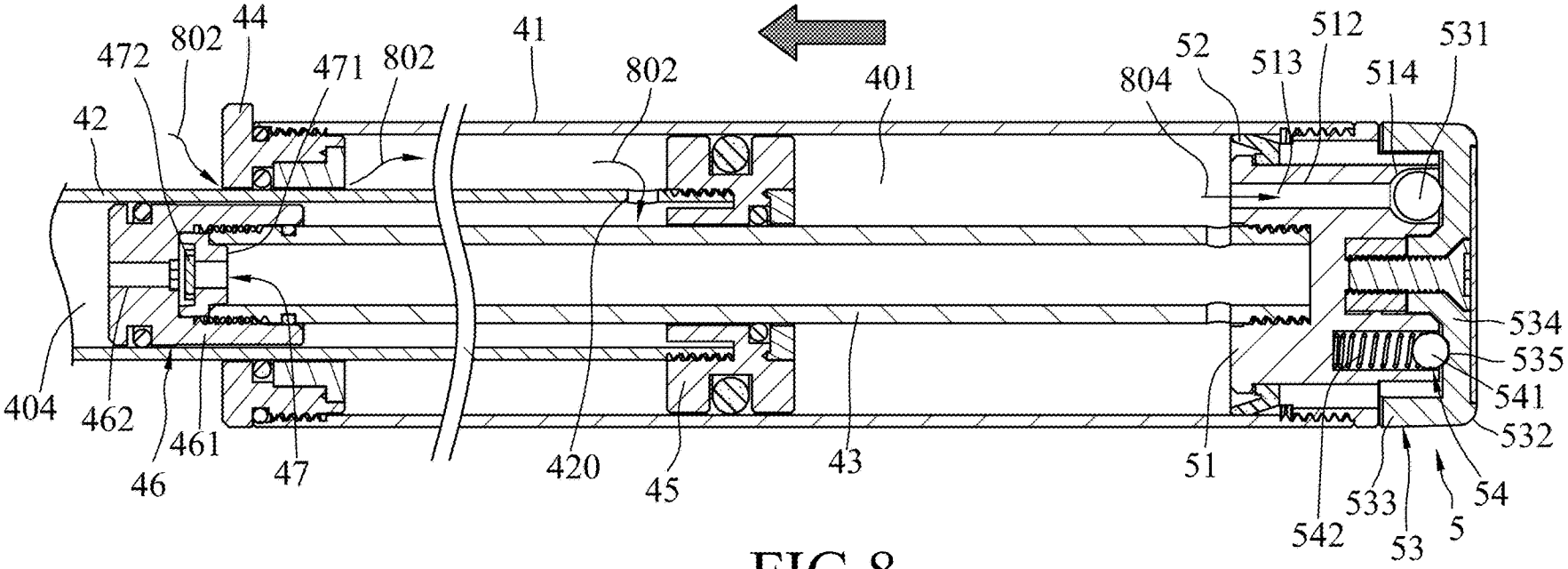
FIG. 8 is a view similar to FIG. 7, illustrating the large-diameter cylinder being move forwardly relative to the mouthpiece when the adjustment mechanism of the embodiment is in a pressure relief state.

Referring to FIGS. 2, 7 and 8, the adjustment mechanism 5 includes an adjustment seat 51 that is fixedly mounted between the rear ends of the large-diameter cylinder 41 and the connecting tube 43, and a unidirectional valve 52, an exhaust valve set 53 and a positioning set 54 that are mounted to the adjustment seat 51. The adjustment seat 51 has an exhaust hole 512 that extends axially and that fluidly communicates the first space 401 to the external environment, a plurality of intake holes 511 that indent from an outer surrounding surface of the adjustment seat 51, that fluidly communicate the first space 401 to the external environment and that are angularly spaced apart, and a mounting groove 515 that indents from a rear surface of the adjustment seat 51. The exhaust hole 512 has a small-diameter exhaust section 513 that is fluidly communicated to the first space 401, and a large-diameter exhaust section 514 that fluidly communicates the small-diameter exhaust section 513 to the external environment and that has a diameter larger than that of the small-diameter exhaust section 513.

The unidirectional valve 52 openably seals the intake holes 511 by sleeving around the adjustment seat 51 to partition the intake hole 511 and the first space 401, and has a valve body 521 that sleevedly abuts the outer surrounding surface of the adjustment seat 51, and a valve gasket 522 that extends radially and forwardly away from the valve body 521 to resiliently and airtightedly abut against the inner surrounding surface of the large-diameter cylinder 41. The valve gasket 522 is permitted to be driven by air pressure difference between the external environment and the first space 401 to deform, allowing free flow therebetween when the atmospheric pressure is greater, and disabling free flow therebetween otherwise.

The exhaust valve set 53 is operable to openably seal the exhaust hole 512, and includes a ball-shaped sealing member 531 that is mounted in large-diameter exhaust section 514 and that is permitted to move axially relative thereto to seal the small-diameter exhaust section 513, and an adjustment member 532 that is mounted to the adjustment seat 51. The adjustment member 532 has an annular portion 533 that is operable to rotatably sleeve around the adjustment seat 51, an interlocking wall portion 534 that is indented with two spaced-apart positioning grooves 535 at a front end surface thereof, that is connected to inner surrounding surface of the annular portion 533, and that faces the rear end surface of the adjustment seat 51, and an abutting portion 536 that protrudes from the front end surface of the interlocking wall portion 534 to be permitted to abut forwardly against the sealing member 531, and that is driven by the annular portion 533 to move relative to the sealing member 531. The adjustment member 532 is operable to rotate relative to the sealing member 531 between a detached position, where the sealing member 531 is not pushed by the abutting portion 536, and a closed position, where the sealing member 531 is pushed by the abutting portion 536 to abut against and to seal the small-diameter exhaust section 513.

The positioning set 54 is mounted between the adjustment seat 51 and the adjustment member 532 of the exhaust valve set 53, and includes a positioning member 541 that is movably mounted to the mounting groove 515 of the adjustment seat 51, and a resilient member 542 that is mounted in the mounting groove 515. The resilient member 542 resiliently biases the positioning member 541 rearwardly toward the interlocking wall portion 534 to removably engage either one of the positioning grooves 535, such that the adjustment member 532 is able to be positioned at the detached position or the closed position.

The adjustment mechanism 5 is permitted to switch between a pressure relief state and a sealed state. While the adjustment mechanism 5 is in the pressure relief state, the adjustment member 532 is at the detached position (see FIG. 8), where the adjustment member 532 is separated from the sealing member 531 so that the sealing member 531 is permitted to be driven by air pressure in the small-diameter exhaust section 513 of the the exhaust hole 512 to move away, thereby allowing fluid communication between the small-diameter and large-diameter exhaust sections 513, 514 of the exhaust hole 512. Since the sealing member 531 does not seal the exhaust hole 512, the exhaust hole 512 may release air from the first space 401 to the external environment. While the adjustment mechanism 5 is in the sealed state, the adjustment member 532 is at the closed position (see FIG. 7), where the adjustment member 532 pushes the sealing member 531 to move toward and to seal the small-diameter exhaust section 513 of the exhaust hole 512, so that the first space 401 may not exhaust air to the external environment.

During the use of the inflator 200, after the mouthpiece 3 is mounted to an inflatable object (not shown), a user is permitted to operate the adjustment member 532 of the exhaust valve set 53 to switch the adjustment mechanism 5 between the pressure relief state and the sealed state. Then, after the user holds onto the mouthpiece 3 with one hand and the large-diameter cylinder 41 with the other hand, the user is able to perform pumping process of the inflator 200 by cyclically pulling and pushing the large-diameter cylinder 41 relative to the mouthpiece 3 in the front-rear direction.

Referring back to FIGS. 3 to 5, when the large-diameter cylinder 41 is pulled rearwardly relative to the mouthpiece 3, the connecting tube 43 and the intake plug 44 are driven alongside the large-diameter cylinder 41 via the adjustment mechanism 5 to move rearwardly relative to the small-diameter cylinder 42, such that the intake plug 44 is sealed and the communication plug 46 is open to fluidly communicate the third space 403 and the fourth space 404. During this "pulling" process, the first space 401 and the fourth space 404 expand in volume, and the second space 402 and the third space 403 shrink in volume. The expansion of the first space 401 generates the negative pressure that drives the unidirectional valve 52 of the adjustment mechanism 5 to be open, and air from the external environment is sucked into the first space 401 via the intake holes 511 and the unidirectional valve 52 of the adjustment mechanism 5 to flow along a first airflow pathway 801. Air in the second space 402 and the third space 403 is pushed to flow into the fourth space 404 via the communication plug 46 along the first airflow pathway 801.

During this time, if the air pressure in the fourth space 404 is smaller than that of the mouthpiece 3, the second check valve set 48 would be sealed, permitting the air pressure in the fourth space 404 to build up. Conversely, if the air pressure in the fourth space 404 is higher than that of the mouthpiece 3, the second check valve set 48 would be driven by the air pressure of the fourth space 404 to open, such that the air in the fourth space 404 is guided by the second check valve set 48 to be fluidly communicated to the mouthpiece 3 for pumping the inflatable object during the "pulling" process.

When the intake plug 44 is retained from moving rearwardly alongside the large-diameter cylinder 41 any further by the piston 45, the inflator 200 is at its maximum extended state. Then, the large-diameter cylinder 41 is pushed forwardly relative to the mouthpiece 3 to return to its original position, where the intake plug 44 is in contact with the mouthpiece 3.

Figure 6:
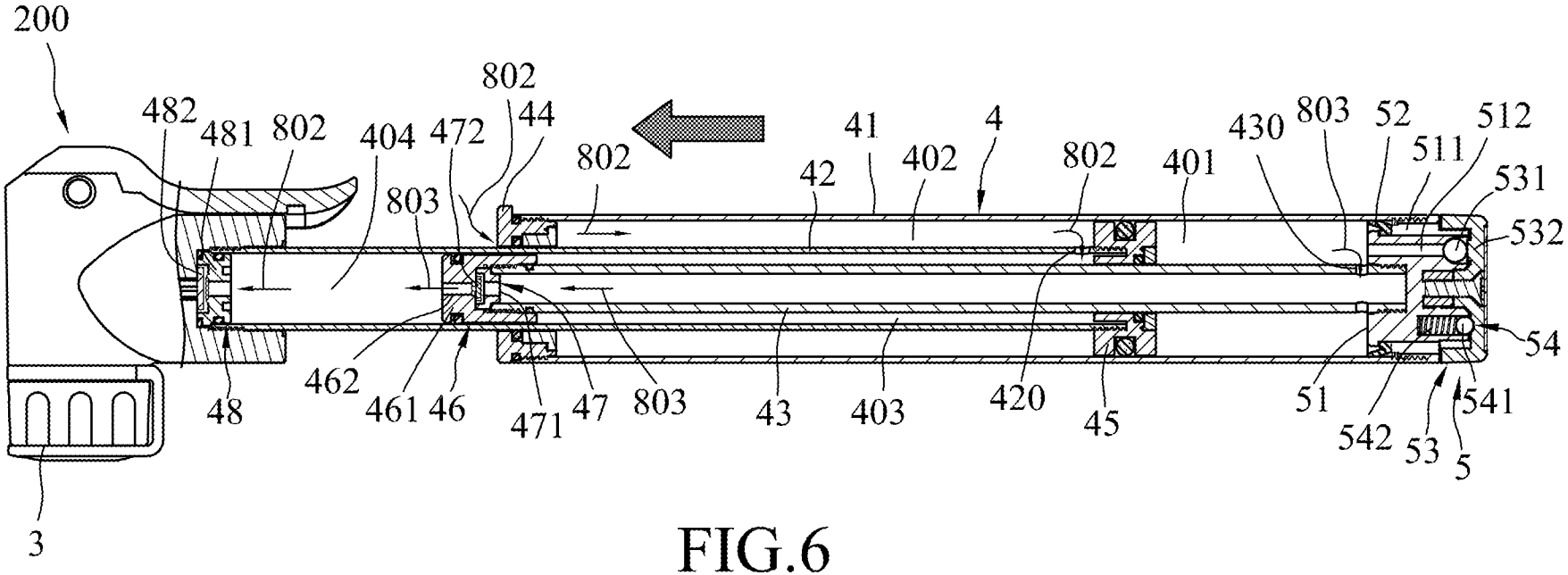
FIG. 6 is a view similar to FIG. 4, illustrating the large-diameter cylinder being move forwardly relative to the mouthpiece when an adjustment mechanism of the embodiment is in a sealed state.

Referring to FIGS. 6 and 7, as the large-diameter cylinder 41 is pushed toward the mouthpiece 3, the first space 401 and the fourth space 404 shrink in volume, the second space 402 and the third space 403 expand in volume, the intake plug 44 is open so that the air from the external environment is sucked into the second space 402 (and into the third space 403 via the through hole 420 of the small-diameter cylinder 42) along a second airflow pathway 802, and the communication plug 46 is sealed to block air flow between the third space 403 and the fourth space 404 therethrough. As the fourth space 404 becomes shrunk in volume, the air pressure in the fourth space 404 builds up and becomes higher than that of the mouthpiece 3, the second check valve set 48 would be driven by the air pressure of the fourth space 404 to open, such that the air in the fourth space 404 is injected into the mouthpiece 3 for pumping the inflatable object along the second airflow pathway 802.

At this time, as the exhaust hole 512 of the adjustment seat 51 is sealed by the exhaust valve set 53 when the adjustment mechanism 5 is in the sealed state, the air in the first space 401 is driven directly sequentially into the connecting tube 43 and the fourth space 404 along a third airflow pathway 803. The check valve member 472 of the first check valve set 47 is driven to open once the air pressure in the connecting tube 43 is higher than that of the fourth space 404. In other words, when the adjustment mechanism 5 is in the sealed state, the mouthpiece 3 is operable to simultaneously supply air from both the first space 401 and the fourth space 404.

Referring to FIG. 8, when the large-diameter cylinder 41 is pushed toward the mouthpiece 3 while the adjustment mechanism. 5 is in the pressure relief state, since the exhaust valve set 53 is open, the air pressure in the first space 401 builds up as the volume thereof decreases, triggering the sealing member 531 to move radially and outwardly, such that the exhaust hole 512 of the adjustment seat 51 is permitted to release the air in the first space 401 into the external environment along the fourth airflow pathway 804. As a result, only the air in the fourth space 404 is injected into the mouthpiece 3.

Overall, by utilizing the sealed and pressure relief states of the adjustment mechanism 5, the inflator 200 is operable to pump the air into the inflatable object with different intensity. Specifically, in the sealed state, the adjustment mechanism 5 permits the air in both the first space 401 and the fourth space 404 to be simultaneously injected into the inflatable object, which is desirable when the inflatable object is in a low pressure state, such that a large amount of air may be swiftly injected thereto before air pressure in the inflatable object begins to build up to resist the supplied air from the inflator 200. Once the air pressure in the inflatable object reaches above a predetermined pressure state such that it becomes difficult for the large-diameter cylinder 41 to perform the inflating process, the adjustment mechanism 5 may be switched to the pressure relief state so that only the air in the fourth space 404 is to be injected into the inflatable object, while the air in the first space 401 is fluidly communicated with the external environment instead and not injected into the inflatable object just to be resisted by the air pressure therefrom. Although less air is being pumped into the inflatable object in the pressure relief state, the inflator 200 is less labor-intensive during this state.

In addition, the design of the adjustment mechanism 5 and the air cylinder mechanism 4 is relatively simple, so that fewer components are needed for assembling the inflator 200, reducing manufacturing cost and chances of malfunctioning.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An inflator comprising:

a mouthpiece;

an air cylinder mechanism including a connecting tube that extends axially in a front-rear direction, a first cylinder that extends axially, that sleeves around said connecting tube and that has a front end fixedly connected to said mouthpiece, a second cylinder that extends axially and that sleeves around said first cylinder a unidirectional intake plug that is fixedly mounted to a front end of said second cylinder and that sleevedly abuts against an outer surrounding surface of said first cylinder, a piston that is fixedly mounted to a rear end of said first cylinder and that airtightly abuts against an inner surrounding surface of said second cylinder and an outer surrounding surface of said connecting tube, a unidirectional communication plug that fluidly communicates said connecting tube and said first cylinder, that is fixedly mounted to a front end of said connecting tube and that abuts against an inner surrounding surface of said first cylinder, a first check valve set that is mounted between said connecting tube and said communication plug, and a second check valve set that removably seals said front end of said first cylinder; and an adjustment mechanism fixedly mounted to a rear end of said second cylinder and a rear end of said connecting tube, cooperating with said piston to define a first space therebetween, and including an adjustment seat that is fixedly mounted between said rear ends of said second cylinder and said connecting tube, and that has an intake hole and an exhaust hole both of which fluidly communicates said first space to external environment, a unidirectional valve that is mounted to said adjustment seat, and that openably seals said intake hole, and an exhaust valve set that is mounted to said adjustment seat, and that is operable to openably seal said exhaust hole;

wherein, said piston and said intake plug cooperatively define a second space therebetween, said communication plug and said piston cooperatively define a third space therebetween that is in fluid communication with said second space, and said communication plug and said second check valve set cooperatively define a fourth space therebetween;

wherein, while said adjustment mechanism is in a pressure relief state, said exhaust valve set does not seal said exhaust hole, so that said exhaust hole may release air from said first space to the external environment;

wherein, while said adjustment mechanism is in a sealed state, said exhaust valve set seals said exhaust hole;

wherein, when said second cylinder is moved away from said mouthpiece, air from the external environment is sucked into said first space via said unidirectional valve of said adjustment mechanism, air in said second space and said third space is pushed to flow into said fourth space via said communication plug, and said second check valve set is capable of being driven by air pressure of said fourth space to open;

wherein, when said second cylinder is moved toward said mouthpiece, the air from the external environment is sucked into said second space via said intake plug and flows into said third space, air in said first space is pushed to flow into said connecting tube and air in said connecting tube is pushed to open said first check valve set while said adjustment mechanism is in the sealed state, and the air in said first space is released via said exhaust hole of said adjustment seat while said adjustment mechanism is in the pressure relief state.

2. The inflator as claimed in claim 1, wherein:

said intake hole of said adjustment seat indents from an outer surrounding surface thereof; and said unidirectional valve sleeves around said adjustment seat to partition said intake hole and said first space, and has a valve body that sleevedly abuts said outer surrounding surface of said adjustment seat, and a valve gasket that extends radially and forwardly away from said valve body to resiliently and airtightedly abut against said inner surrounding surface of said second cylinder.

3. The inflator as claimed in claim 1, wherein: said exhaust hole of said adjustment seat has a first exhaust section that is fluidly communicated to said first space, and a second exhaust section that fluidly communicates said first exhaust section to the external environment and that has a diameter larger than that of said first exhaust section; said exhaust valve set includes a sealing member that is mounted in said second exhaust section and that is permitted to seal said first exhaust section, and an adjustment member that is mounted to said adjustment seat; when said adjustment mechanism is in the sealed state, said sealing member is pushed by said adjustment member to move toward and to seal said first exhaust section; and when said adjustment mechanism is in the pressure relief state, said adjustment member is separated from said sealing member so that said sealing member is permitted to be driven by air pressure in the first exhaust section to move away, thereby allowing fluid communication between said first and second exhaust sections.

4. The inflator as claimed in claim 3, wherein:

said adjustment member of said exhaust valve set has an annular portion that is operable to rotatably sleeve around said adjustment seat, and an abutting portion that is driven by said annular portion to move relative to said sealing member;

said adjustment member is operable to rotate between a detached position, where said sealing member is not pushed by said abutting portion, and a closed position, where said sealing member is pushed by said abutting portion to abut against and to seal said first exhaust section.

5. The inflator as claimed in claim 4, wherein said adjustment mechanism further includes a positioning set that is mounted between said adjustment seat and said adjustment member of said exhaust valve set, and that facilitates positioning of said adjustment member at either of the detached position and the closed position.

6. The inflator as claimed in claim 5, wherein:

said adjustment seat further has a mounting groove that indents from a rear end surface thereof;

said exhaust hole of said adjustment seat extends axially; said sealing member of said exhaust valve set is permitted to move axially relative to said second exhaust section;

said adjustment member of said exhaust valve set further has an interlocking wall portion that is indented with two spaced-apart positioning grooves at a front end surface thereof, that is connected to inner surrounding surface of said annular portion of said exhaust valve set, and that faces said rear end surface of said adjustment seat, said abutting portion of said exhaust valve set protruding from said front end surface of said interlocking wall portion to be permitted to abut forwardly against said sealing member;

said positioning set includes a positioning member that is movably mounted to said mounting groove of said adjustment seat, and a resilient member that is mounted in said mounting groove and that resiliently biases said positioning member rearwardly toward said interlocking wall portion to removably engage either one of said positioning grooves, such that said adjustment member is able to be positioned at the detached position or the closed position.

7. The inflator as claimed in claim 1, wherein:

said communication plug of said air cylinder mechanism includes a plug body that is fixedly mounted to said front end of said connecting tube and that has an axial hole axially and fluidly communicating said connecting tube and said fourth space of said air cylinder mechanism, and a piston gasket that is axially movable, that sleeves around said plug body and that airtightly abuts against said inner surrounding surface of said first cylinder;

said plug body has an outer annular groove that indents from an outer surface thereof and that is for said piston gasket to sleeve thereto, and a cutoff opening that axially and fluidly communicates said outer annular groove and said fourth space;

when said plug body moves rearwardly relative to said first cylinder, said piston gasket unseals said cutoff opening so that said third space is fluidly communicated to said fourth space, and when said plug body moves forwardly relative to said first cylinder, said piston gasket seals communication between said cutoff opening and said third space to airtightly partition said third space and said fourth space;

said first check valve set of said air cylinder mechanism has an annular valve seat that fluidly communicates said connecting tube to said axial hole, and a check valve member that is mounted to said valve seat and that is permitted to be driven by air pressure of said connecting tube to openably seal said valve seat.

8. The inflator as claimed in claim 1, wherein said second check valve set of said air cylinder mechanism includes an annular valve block that is fixedly mounted in said front end of said first cylinder and that fluidly communicates said mouthpiece to said fourth space of said air cylinder mechanism, and a check valve member that is mounted to said valve block and that is permitted to be driven by air pressure of said forth space to openably seal said valve block.

* * * * *